United States Patent [19]

Bennett

[11] Patent Number: 4,668,927

[45] Date of Patent: May 26, 1987

[54] RELAY SWITCH APPARATUS

[75] Inventor: James E. Bennett, Worthington, Ohio

[73] Assignee: American Telephone & Telegraph Co., AT&T Bell Labs, Murray Hill, N.J.

[21] Appl. No.: 836,757

[22] Filed: Mar. 6, 1986

[51] Int. Cl.[4] ..... H01H 1/08

[52] U.S. Cl. ..... 335/58; 335/47

[58] Field of Search ..... 335/58, 57, 55, 49, 335/47; 200/182, 209, 210

[56] References Cited

U.S. PATENT DOCUMENTS

| | | | |
|---|---|---|---|
| 2,445,406 | 7/1948 | Pollard, Jr. | 335/58 |
| 3,356,813 | 5/1967 | Shinohara et al. | 200/152 |
| 3,904,999 | 9/1975 | Rich et al. | 335/52 |
| 3,976,960 | 8/1976 | Bitko et al. | 335/58 |
| 4,085,392 | 4/1978 | Lacis et al. | 335/58 |
| 4,134,088 | 1/1979 | Asbell et al. | 335/51 |
| 4,148,000 | 4/1979 | Lacis et al. | 335/58 |
| 4,164,720 | 8/1979 | Bollen | 335/47 |
| 4,199,739 | 4/1980 | Deith | 335/58 |
| 4,236,129 | 11/1980 | Lacis et al. | 335/55 |
| 4,368,442 | 1/1983 | Yamaguchi et al. | 335/57 |

*Primary Examiner*—Harold Broome

*Attorney, Agent, or Firm*—Dwight A. Marshall

[57] ABSTRACT

A multi-positional mercury switch (1, 2) for use with miniature relays. The mercury switch apparatus has mercury wettable magnetic contact structures (11, 12, 13, 21, 22) supported in a sealed envelope member (10, 20) supporting the magnetic contact structures with free ends thereof positioned to engage or disengage each other in response to a magnetic field generated by current appearing in a coil (410) externally surrounding the envelope member. A mercury wettable member (3, 15, 23, 24) having a porous construction for holding mercury is mounted on ones of the magnetic contact structures within the sealed envelope member for wetting the magnetic contact structures.

11 Claims, 4 Drawing Figures

RELAY SWITCH APPARATUS

BACKGROUND OF THE INVENTION

1. Field of the Invention

This invention relates to relay apparatus. In particular, it relates to electromagnetically actuated switches used in relay apparatus.

2. Description of the Prior Art

Sealed contact switches are well-known in the Electronic and Communication Industry and have found extensive application in electrical systems performing a wide range of switching functions. A typical switch comprises a pair of reed members or pole-pieces and stem armature assemblies suspended at their ends by an envelope, usually glass, such that an armature of the stem armature assembly overlaps contact surfaces of the pole-pieces. A relay is constructed utilizing a switch such that an electrical winding encircling the envelope generates a magnetic field for actuating the armature of the switch to engage and disengage contact surfaces of the pole-piece members and thereby control an external electrical circuit connected with the relay. Such switches serve well in particular circuit applications; however, the irregular surface character of the pole-piece contacts and stem armature reduces the areas of contact upon engagement and renders the switch essentially current limited in that current of a magnitude beyond a predetermined value tends to cause melting of the irregular contact surfaces which increases the tendency of the pole-piece contact and armature to stick together in a closed position.

The current carrying capacities of such switches may be increased by the employment of the well-known mercury-wetted type of switches. Typically, mercury wettable surfaces enable an electrical connection to be uniformly established over the entire surface of the contacts. In such a switch, a pool of mercury located in one end of the envelope moves by capillary action over the stem and armature to wet the contact surfaces of the armature and pole-pieces and thereby increase the current capacity of the switch. A problem occurs with these type of mercury switches in that they are position sensitive. If they are mounted in one position, the pool of mercury will shift thereby shorting the reed members or the stem armature and pole-piece contact surfaces together rendering the switch inoperable. If the switch is mounted in another position, the pool of mercury may be shifted to a location within the switch away from the reed members and from the stem armature and pole-piece assemblies thereby creating dry contacts that result in a lower current carrying capacity of the switch.

Accordingly, a need exists for a multi-positional mercury switch that may be mounted in any position in electrical and electronic equipment. A need also exists for a mercury relay having a multi-positional switch assembly that requires less mercury to obtain the current rating of previous switch assemblies.

SUMMARY OF THE INVENTION

The foregoing problems are solved and a technical advantage is achieved by a mercury switch construction having a mercury wettable member formed with a porous surface holding mercury and mounted on magnetic contact structures within an envelope member for wetting the magnetic contact structures regardless of the position of the switch construction.

In accordance with the invention, a mercury switch construction comprises mercury wettable magnetic contact structures and an envelope member for supporting the magnetic contact structures with the free ends thereof positioned to overlap and engage each other. A mercury wettable member formed with a porous surface holding mercury is mounted on the magnetic contact structures within the envelope member for wetting the magnetic contact structures.

Also in accordance with the invention, a mercury switch construction comprises a pair of mercury wettable magnetic reed members and an envelope member for oppositely supporting each of the reed members with the free ends thereof positioned in an overlap position to engage each other. Mercury wettable members are mounted within the envelope member on the magnetic reed members with each formed of a mercury wettable alloy having a porous surface or sponge-like structure having cavities holding mercury for wetting the magnetic reed members.

Also in accordance with the invention, a mercury switch construction comprises a magnetic pole-piece having a mercury wettable contact positioned on one end thereof and a mercury wettable magnetic stem having a mercury wettable armature attached on one end thereof. An envelope member oppositely supports the magnetic pole-piece and stem with a free end of the armature positioned to overlap and engage the pole-piece contact. A member is mounted within the envelope member on the stem and is formed of a mercury wettable alloy having a porous structure for holding mercury to wet the stem, armature and pole-piece contact.

In further accordance with the invention, a multi-positional magnetic mercury relay comprises a housing having terminals extending therefrom and a bobbin located in the housing with an energizing coil wound thereon and connected to ones of the housing terminals. Switch apparatus enclosed by the bobbin is coupled to other ones of the housing terminals for interconnecting the switch coupled terminals in response to electrical signals applied to the coil connected terminals. The switch apparatus comprises a pair of magnetic pole-pieces each having a mercury wettable contact positioned on one end thereof and a mercury wettable magnetic stem with a mercury wettable armature attached to one end. A sealed envelope member supports the pole-pieces at one end thereof with the pole-piece contacts spaced apart and facing each other. The sealed envelope supports the stem and armature at an opposite end of the sealed envelope with a free end of the armature positioned to overlap both and normally engage one of the pole-piece contacts. The stem and pole-pieces extend from the sealed envelope member for interconnection with the housing switch terminals. A member mounted within the envelope member on the stem is formed of a mercury wettable ceramic or nickel-iron alloy having a porous structure for holding mercury wetting the stem, armature and pole-piece contacts.

DESCRIPTION OF THE DRAWING

The foregoing as well as other objects, features and advantages of the invention will be more apparent from a description of the drawing in which.

DESCRIPTION OF THE INVENTION

Figure 1:
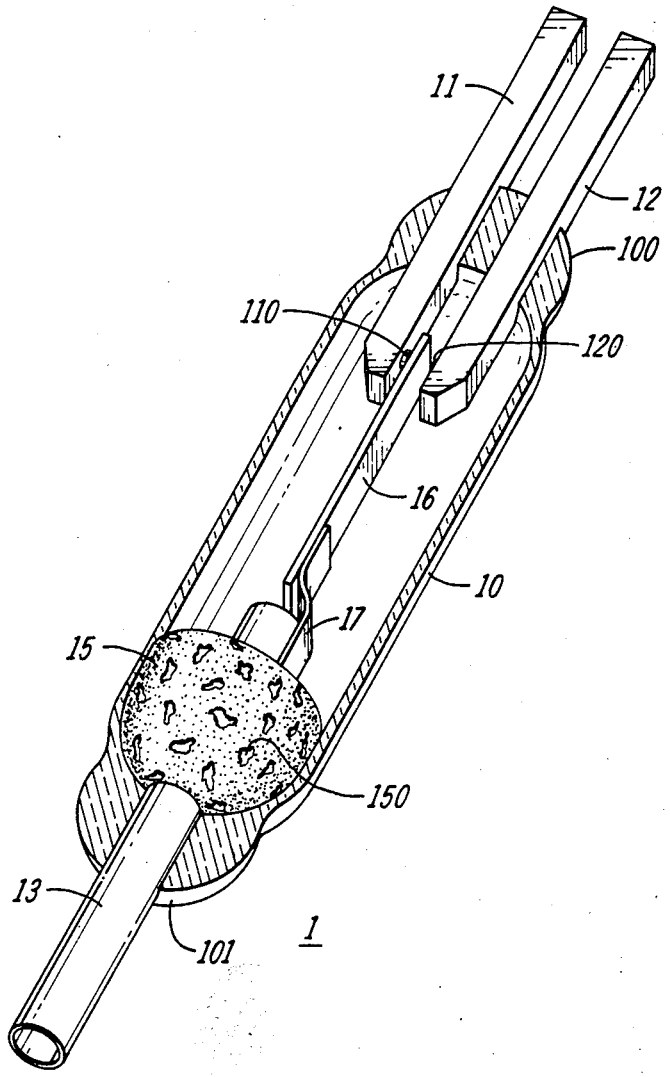
FIG. 1 is a perspective view illustrating switch apparatus embodying the principles of the instant invention.

Referring now to FIG. 1 of the drawing, switch apparatus 1 set forth therein is a mercury switch construction having transfer contacts wherein an electrical path may by operation of the switch be transferred from one contact to another. More specifically, in a first embodiment of the invention, mercury switch apparatus 1 has a pair of magnetic pole-pieces 11, 12 formed of a nickel-iron alloy sometimes referred to as a 52 alloy. During assembly, each pole-piece 11 and 12 has a mercury wettable button which may be formed of nickel, copper and tin affixed to an end thereof either by welding or any one of a number of well-known methods. The pole-piece and contact assembly are then chromium plated and oxidized to form a non-wettable mercury surface.

Each button is then ground or subjected to an electronic discharge machine to expose a surface thereby forming a mercury wettable contact 110 and 120 positioned at the end of pole-pieces 11 and 12 respectively. Mercury switch apparatus 1 also has a magnetic stem 13 formed of the mercury wettable nickel-iron alloy. An armature 16 formed of a mercury wettable permalloy material is attached by a mercury wettable molybdenum flexible hinge 17 to stem 13. Member 15 may be formed of a mercury wettable nickel-iron alloy or other mercury wettable material to have a porous surface with cavities 150 formed therein for holding small amounts of mercury that continuously wet the surface. The porous member 15 is affixed to stem 13 such that porous member 15, stem 13, hinge 17 and armature 16 form an integral assembly.

Figure 3:
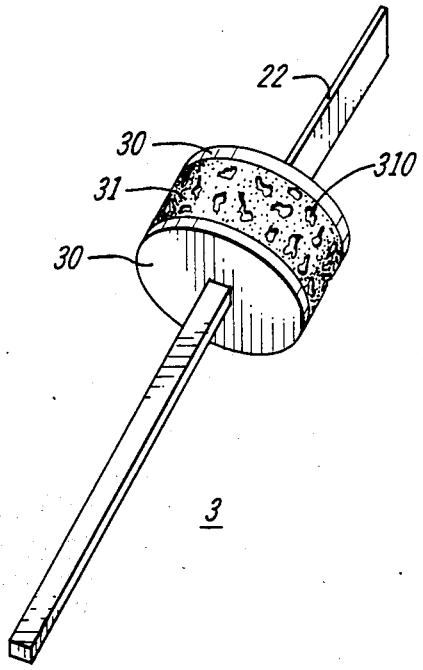
FIG. 3 sets forth details of a magnetic wettable porous member structure that may be used in the switch construction of FIGS. 1 and 2, and FIG. 4 sets forth a perspective view of a multi-positional mercury relay employing the switch apparatus set forth in FIGS. 1, 2 and 3.

Although member 15 has been described as having a porous surface, it is to be understood that several other configurations are possible within the teaching of the invention. For example, member 15 may, in another embodiment of the invention, be formed of a mercury wettable alloy or material to have a sponge-like structure having cavities throughout that are intended to be used for holding mercury. In yet another embodiment of the invention, member 15 may, as set forth in FIG. 3 of the drawing, be a sponge-like disk 31 formed of a ceramic material or metallic alloy having cavities 310 each intended for holding a small amount of mercury. Disk 31 is positioned between a pair of cover members 30 formed of a mercury wettable material and affixed to disk 31 such that the entire structure may be mounted on stem 13 of switch apparatus 1 of FIG. 1.

In assembly, an envelope member 10, which typically may be a glass envelope, but is not limited thereto, is arranged to support the pair of pole-pieces 11, 12 at one end 100 with the pole-piece contacts 110, 120 spaced apart and facing each other. Magnetic stem 13, with porous member 15 mounted thereon, is supported at end 101 of envelope member 10 with porous member 15 located within envelope 10. The ends 100 and 101 are sealed about pole-pieces 11, 12 and stem 13, respectively, to form a sealed envelope member 10 with magnetic stem 13 supported at end 101 such that the free end of armature 16 is positioned in between pole-pieces 11 and 12 to overlap both pole-piece contacts 110, 120 and normally engage one of the pole-piece contacts such as pole-piece contact 110.

In assembled switch apparatus 1, member 15 mounted on magnetic stem 13 holds mercury in cavities 150 regardless of the position of switch apparatus 1. The porous surface of member 15 is wetted by the mercury which in turn moves by capillary action along magnetic stem 13, hinge 17 and the end of armature 16 thereby wetting the engaged contact 110 of magnetic pole-piece 11. When an electric signal is applied to a coil winding surrounding sealed envelope member 10, armature 16 responds thereto by disengaging from pole-piece contact 110 and engaging contact 120 of pole-piece 12. The engagement of armature 16 with contact 120 results in the mercury appearing at the end of armature 16 wetting contact 120. Mercury wetted contacts 110 and 120 provide a more uniform contact surface and thereby increase the current carrying characteristics of mercury switch apparatus 1 when transfer electrical paths are established between magnetic stem 13 and pole-pieces 11 and 12. Porous member 15 holds small amounts of mercury in cavities 15 disposed over the surface of member 15 thereby insuring the wetting of armature 16 and pole-piece contacts 110, 120 regardless of the position of mercury switch apparatus 1.

In another embodiment of the invention not shown in the drawing, mercury switch apparatus 1 may be constructed with a single magnetic pole-piece, for example, pole-piece 11 supported by end 100 of sealed envelope member 10. In this switch construction, magnetic stem 13 is oppositely supported at end 101 of envelope 10 with the free end of armature 16 overlapping and in a spaced apart relationship with pole-piece contact 110. An electrical signal applied to a coil winding surrounding sealed envelope member 10 positions mercury wetted armature 16 to engage contact 110 thereby establishing an electrical path between magnetic stem 13 and pole-piece 11. As earlier set forth, member 15 may be a sponge-like member having cavities 150 located throughout that holds mercury for wetting magnetic stem 13, hinge 17, armature 16 and pole-piece contact 110 regardless of the oritentation of switch apparatus 1.

Figure 2:
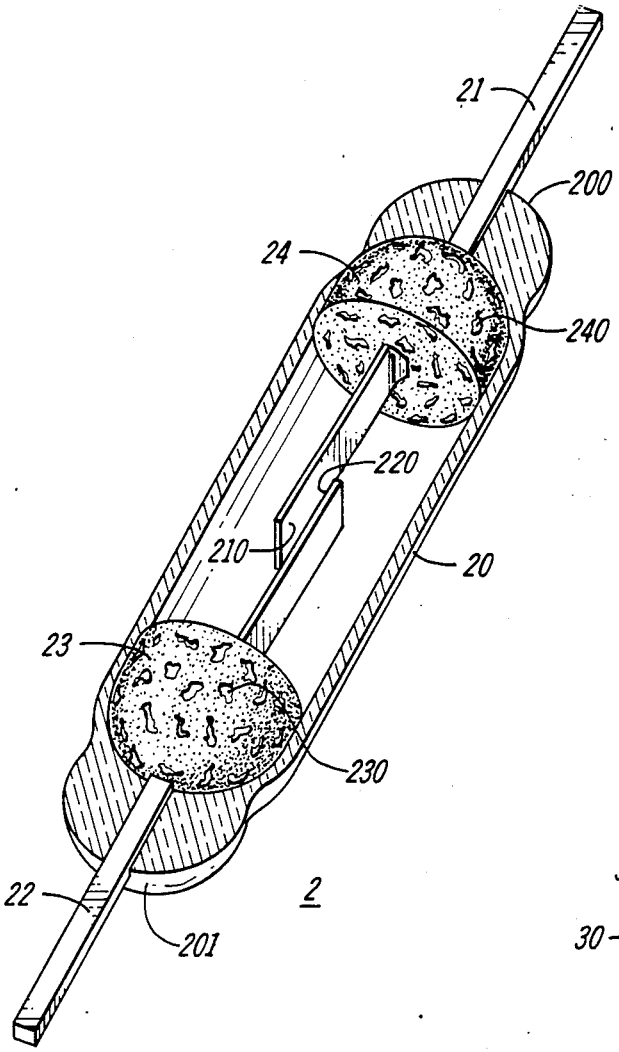
FIG. 2 depicts in perspective view other switch apparatus embodying the principles of the instant invention.

Referring now to FIG. 2, switch apparatus 2, set forth therein is a mercury switch construction having a pair of reed members 21 and 22 each having a mercury wetted contact surface 210 and 220, respectively, located at the end thereof. Envelope member 20 supports reed member 21 at sealed end 200 and reed member 21 at opposite sealed end 201 with free end contact surfaces 210 and 220 positioned to overlap each other in a spaced apart relationship. Reed members 21 and 22 respond to a magnetic field generated by electrical signals applied to a coil 410, FIG. 4, encircling sealed envelope member 20 by positioning reed members 21 and 22 to engage overlapped contact surfaces 210 and 220, FIG. 2, to establish an electrical path between reed members 21 and 22. In one embodiment of the invention, members 23 and 24 may be formed of a mercury wettable nickel-iron metallic alloy having a range between 80 to 50 percent nickel and 20 to 50 percent iron, respectively, or of a ceramic material wherein each may have a porous surface or a sponge-like structure having cavities 230 and 240, respectively. Mercury wettable members 23 and 24 are each mounted within sealed envelope member 20 on reed members 22 and 21, respectively. Mercury held in cavities 230 and 240 wet the surfaces of members 23 and 24 and moves by capillary action along reed members 21 and 22 to wet contact surfaces 210 and 220. In another embodiment of the invention, switch apparatus 2 may be constructed with one mercury holding member 23 or 24 which is located within sealed envelope member 20 and mounted on one of the reed members 21 and 22. A mercury holding member, for example member 24, may be mounted on reed member 21, such that the mercury moves by capillary action along reed member 21 to wet contact surface 210. Operation of switch apparatus 2 positions reed members 21 and 22 to engage contact surfaces 210 and 220 thereby wetting contact surface 220. Similarly, a single mercury holding member 23 may be mounted in envelope member 20 on reed member 22 to wet both contact surfaces 210 and 220. In addition, the mercury holding members 23, 24 may be the mercury holding structure set forth in FIG. 3 of the drawing. The mercury holding members 23, 24 hold a small amount of mercury in cavities 230, 240 disposed about the porous surface and throughout the sponge structure to enable the wetting of reed members 21, 22 regardless of the mounting position and orientation of switch apparatus 2.

Figure 4:
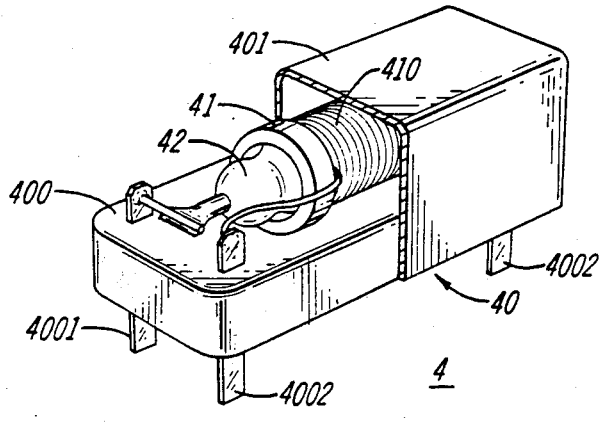

Switch apparatus 1 and 2, and the various embodiments thereof, may be of a part of a multi-positional mercury relay such as magnetic mercury relay 4 set forth in FIG. 4 of the drawing. Relay 4 has a housing 40 comprising a cover member 401 and a base member 400 with a number of terminals 4001, 4002 embedded therein and extending from top and bottom surfaces thereof. Bobbin member 41 is located within housing 40 and has an energizing coil 410 wound thereon with the coil leads connected to base terminals 4002. Switch apparatus 42 may be switch apparatus 1 and 2 as set forth in FIGS. 1 and 2 respectively, and is enclosed by bobbin member 41 and energizing coil 410 with the switch stem 13, pole-pieces 11, 12 or reed members 21, 22, coupled to other base member terminals 4001. Electrical signals applied to the coil terminals 4002 enable switch apparatus 42 to interconnect stem 13, FIG. 1, via armature 16 with pole-pieces 11, 12 and, FIG. 2, reed members 21, 22 thereby establishing electrical paths between terminals 4001. Relay 4 may be a magnetic relay having one or more magnets, not shown in the drawing, which may be positioned within housing 40 adjacent switch apparatus 42 to provide a magnetic field defining an initial status of switch apparatus 42.

SUMMARY

It is obvious from the foregoing that the facility, economy and efficiency of mercury relays may be substantially enhanced by mercury switch apparatus that enables a mercury relay to be mounted in any position in electrical and electronic equipment. It is further obvious from the foregoing that a mercury switch construction with a mercury wetted member having a porous surface and sponge-like structure with cavities holding small amounts of mercury sealed in an envelope for wetting contact structures regardless of the mounting position of the mercury switch construction expands the use of mercury relays in electrical and electronic equipment.

What is claimed is:

1. A mercury switch construction (2) comprising magnetic contact structures (21, 22), and means (20) for supporting said magnetic contact structures with free ends thereof positioned to engage each other characterized in that said mercury switch construction further comprises magnetic contact structures comprising first and second magnetic reed members (21, 22) oppositely mounted in said supporting means and each having a free end (210, 220) thereof positioned to overlap and engage a free end of said other magnetic reed member, and a pair of mercury wettable members (23, 24) formed of a nickel-iron alloy with each mounted within said supporting means on one of said magnetic reed members and each having a porous surface with cavities (230, 240) thereon holding mercury for wetting said first and second reed members.

2. The mercury switch construction set forth in claim 1 characterized in that said mercury wettable member comprises a nickel-iron alloy formed to have a sponge-like structure having cavities throughout intended for holding mercury to wet said magnetic contact structures.

3. The mercury switch construction set forth in claim 2 characterized in that said mercury wettable member comprises a porous nickel-iron alloy disk member (31) formed to have said sponge-like structure positioned between a pair of cover members (30) with said disk sponge-like structure having cavities (310) throughout for holding mercury to wet said magnetic contact structures.

4. The mercury switch construction set forth in claim 3 characterized in that said nickel-iron alloy comprises an alloy having a range of 50 to 80 percent of nickel and 20 to 50 percent iron, respectively.

5. The mercury switch construction set forth in claim 3 characterized in that said mercury wettable member is formed of a ceramic material having cavities formed throughout for holding mercury to wet said magnetic contact structures.

6. A mercury switch construction (2) comprising a pair of mercury wettable magnetic reed members (21, 22), and an envelope member (20) for oppositely supporting each of said reed members with free ends (210, 220) thereof positioned in an overlap position to engage each other characterized in that said mercury switch construction further comprises means (3, 23, 24) mounted within said envelope member on said reed members and formed of a mercury wettable alloy having a porous surface with cavities (310, 230, 240) thereon holding mercury for wetting said magnetic reed members.

7. The mercury switch construction set forth in claim 6 characterized in that said mercury wetting means comprises a pair of disk members (3) each mounted within said envelope member on one of said reed members and each formed of a mercury wettable nickel-iron alloy having a sponge-like structure with cavities (310) holding mercury for wetting said reed members.

8. The mercury switch construction set forth in claim 6 characterized in that said mercury wetting means comprises a disk member (3) mounted within said envelope member on one of said reed members and formed of a mercury wettable nickel-iron alloy having a sponge-like structure with cavities (310) holding mercury for wetting said reed members.

9. A mercury switch construction (1) comprising a magnetic pole-piece (11) and a stem (13) having a magnetic armature (16) attached at one end thereof, and means (10) for oppositely supporting said pole-piece and said stem with a free end of said armature positioned to overlap and engage a free end (10) of said pole-piece.

said mercury switch construction further comprises mercury wetting means mounted on said stem and having a porous nickel-iron alloy disk member (31) with a range of 50 to 80 percent of nickel and 50 to 20 iron, respectively, and formed to have a sponge-like structure positioned between a pair of cover members (30) with said disk sponge-like structure having cavities (310) throughout for holding mercury to wet said pole-pieces, stem and armature.

10. A mercury switch construction (1) comprising a pair of magnetic pole-pieces (11, 12) and a stem (13) having a magnetic armature (16) attached at one end thereof, and means (10) for oppositely supporting said pole-pieces and said stem with a free end of said armature overlapping and positioned between said pair of pole-pieces with said armature free end normally engaged with one of said pole-pieces characterized in that said mercury switch construction further comprises mercury wetting means mounted on said stem and having a porous nickel-iron alloy disk member (31) with a range of 50 to 80 percent of nickel and 50 to 20 iron, respectively, and formed to have a sponge-like structure positioned between a pair of cover members (30) with said disk sponge-like structure having cavities (310) throughout for holding mercury to wet said pole-pieces, stem and armature.

11. The mercury switch construction set forth in claim 9 or 10 characterized in that said porous disk member is formed of a ceramic material having cavities formed throughout for holding mercury to wet said pole-pieces, stem and armature.

* * * * *